United States Patent [19]

Adams

[11] Patent Number: 4,827,896

[45] Date of Patent: May 9, 1989

[54] INTERNAL COMBUSTION ENGINE WITHOUT CONNECTING RODS

[76] Inventor: Lloyd M. Adams, 6520 Oceanview, Carlsbad, Calif. 92009

[21] Appl. No.: 114,046

[22] Filed: Oct. 29, 1987

[51] Int. Cl.[4] ..... F02B 75/32

[52] U.S. Cl. ..... 123/53 A; 123/197 AC

[58] Field of Search ..... 123/53 R, 53 A, 53 B, 123/57 R, 57 A, 57 B, 197 R, 197 A, 197 AC, 197 AB

[56] References Cited

U.S. PATENT DOCUMENTS

| | | | |
|---|---|---|---|
| 1,978,058 | 10/1934 | Peterson | 123/197 AC |
| 3,474,768 | 10/1969 | Anesetti | 123/53 A |
| 4,274,369 | 6/1981 | Rhoads | 123/53 A |

FOREIGN PATENT DOCUMENTS

| | | | |
|---|---|---|---|
| 0738713 | 9/1943 | Fed. Rep. of Germany | 123/197 AC |
| 2602436 | 7/1977 | Fed. Rep. of Germany | 123/197 AC |
| 0349455 | 11/1960 | Switzerland | 123/197 AC |
| 0024298 | 7/1915 | United Kingdom | 123/53 A |

*Primary Examiner*—Willis R. Wolfe

*Attorney, Agent, or Firm*—John J. Murphey

[57] ABSTRACT

A reciprocating, multicylinder, 4-cycle internal combustion engine having a rotating power output crankshaft wherein the conventional connecting rod is replaced by a carrier member, attached to the piston and directed toward the open end of the cylinder and a guide member pivotally attached to the crankshaft throw, interconnecting with the carrier member in sliding relationship along a path lying in a plane normal to the axis of rotation of the crankshaft. It is preferred that two such cylinders are used in side-by-side, parallel arrangement with a power stroke in alternate cylinders so that each downward stroke of the pistons in unison involves a power stroke.

7 Claims, 5 Drawing Sheets

INTERNAL COMBUSTION ENGINE WITHOUT CONNECTING RODS

BACKGROUND OF THE INVENTION

1. Field of the Invention

This invention relates to the field of reciprocating, multi-cylinder internal combustion engines having rotating power output crankshafts such as are used in powering automobiles, trucks, boats airplanes and the like. More particularly. this invention relates to 4-cycle internal combustion engines of the in-line variety.

DESCRIPTION OF THE PRIOR ART

The operation of an internal combustion engine is fairly well known. Power is obtained from heat produced by the explosion of a fuel/air mixture within a cylinder through the driving of a piston therein whose reciprocating motion is translated into the rotary motion of the output crankshaft through connecting rods. In gasoline-powered internal combustion engines, the explosion is produced by a spark whereas in a diesel internal combustion engine the explosion is produced by the heat generated in the compression cycle. In 2-cycle engines the cylinder is fed with a combustible fuel/air mixture for each upward stroke of the piston so that each downward stroke is a power stroke whereas in the 4-cycle internal combustion engine the power strokes are separated by downward strokes where the cylinder is charged with a fresh fuel/air mixture. In addition to the cylinder and the piston that reciprocates therein, the combustion chamber is generally considered to have associated therewith valves for passing the fuel/air mixture into the cylinder and exhausting the spent fumes therefrom as well as spark means for gasoline and other non diesel fuel type applications as well as the various lines and wires normally associated with transferring fuel, air and electrical energy to an internal combustion engine.

The connecting rod attaching the reciprocating piston, through the open end of the cylinder, to the rotating crankshaft s pivotally attached to the center of the piston by a wrist pin and is attached to the crankshaft at a displaced portion or offset thereof called a "crankshaft throw". This arrangement has always had problems associated therewith.

For instance, the angle of the connecting rod to the vertical at the mid die of the piston travel causes a severe side thrust through the piston against the cylinder wall and causes substantial wear to the lower portion of the cylinder. Further, because of the long, narrow design of the connecting rod, a certain amount of flexing is developed when the engine is subject to high stress loads causing a weakening of the connecting rod and a loss of power in the engine output. Still further, the power impulse of the downwardly driven piston acts on a torque arm against the crankshaft which reaches a maximum approximately 75° after top dead center (ATDC) and at an angle between the rod and the cylinder axis of approximately 15° causing a loss of torque suffered as a result of the power being delivered through less than 90° after top dead center (ATDC) of crank rotation and not in the same direction as the piston travel. Also, with only one piston and connecting rod per cylinder, in in-line internal combustion engines, a longer crankshaft is required for any number of cylinders. Finally, the length of the connecting rod needed to complete one revolution of the crankshaft throw and yet not strike the cylinder walls during reciprocation of the piston requires that the cylinders be spaced apart from the crankshaft thus requiring more metal and more weight in the overall engine construction.

The prior art has dealt with these problems only sporadically, see U.S. Pat. Nos. 1,372,955; 1,528,002; 1,905,754; 1,946,718; 3,200,800; 3,403,508, and 3,828,741. In some inventions, more than one connecting rod is tied together for a particular crankshaft throw, such as in U.S. Pat. Nos. 1,528,002; 1,905,754 and 1,946,718. However, they all still use the extended connecting rod which retains the previous problems of imparting side wall stress to the cylinder walls and flexation during moments of severe engine stress as aforesaid.

This invention is a novel development in the design of reciprocating, multi-cylinder internal combustion engines that solves all of the aforesaid problems. In this invention, the connecting rod is replaced by a combination of elements that provide for a sliding motion in a plane lying normal to the axis of rotation of the crankshaft to convert the rectilinear motion of the reciprocating pistons into rotary motion of the crankshaft. In this invention, a plurality, and preferably two, adjacent pistons in separate cylinders are joined together by a carrier member at the open ends of the cylinders and slidably attached to a guide member that is pivotally connected to the offset throw of the output crankshaft. The carrier member and the guide member interact in sliding relationship during reciprocating motion of the pistons in a plane normal or perpendicular to the axis of the output crankshaft.

A number of benefits are derived from this new mechanical interconnection. In the first place, the reactive side thrust against the cylinders from the whipping action of the connecting rod is totally eliminated; all connection to the pistons remains axial throughout piston movement. The side-to-side sliding action of the members has no significant lateral component against the cylinder walls. In addition, the initial power impulse from the traveling piston acts on an increasing torque arm for a full 90° of crankshaft rotation ATDC to provide a longer and smoother power stroke on the crankshaft rather than in the power stroke previously described with respect to the standard connecting rod. Further, because there is no longer the need for the elongated connecting rod, engines may be made more compact, of lighter materials and the pistons and cylinders spaced closer to the crank shaft to make a more compact design and provide for better engine balance and smoothness of operation. Still further, engine balance and smoothness of operation are enhanced since the vertical motion of the piston pairs in their bores is simple harmonic in nature thus precluding net secondary forces that develop with connecting rods; elimination of these secondary forces as well as the reactive side thrust of the connecting rods permits the engine block and internal components to be made lighter weight than previously thought possible.

SUMMARY OF THE INVENTION

The invention comprises arranging a plurality, and preferably pairs of, pistons in adjacent side-by-side parallel cylinders and connecting each pair of pistons to a carrier member so that the pistons operate in unison; a guide member is pivotally attached to an offset throw formed in the output crankshaft and the carrier member and guide member interconnected in sliding relationship to interact along a reciprocating path lying in a plane normal &o the axis of rotation of the crankshaft. The rectilinear motion of the pistons is thus converted into rotary motion of the crankshaft. In the 4-cycle internal combustion engine, the combustion chambers are most conveniently arranged to provide a power stroke in alternate cylinders during each unitary stroke of the piston pairs through a carrier member and the guide member to the crankshaft thereby duplicating the operation of a conventional connecting rod engine.

Accordingly, the main object of this invention is an internal combustion engine having the typical elongated connecting rod replaced with a combination of components to eliminate side thrust on the cylinder walls, flexation in the interconnection between the piston and the crankshaft, and that permits a more compact engine to be designed and manufactured. Other objects of the invention include an internal combustion engine having smoother running operation and an extended life. These and other objects of the invention will become more apparent upon reading the following description of the preferred embodiment taken together with the drawings attached hereto The scope of protection sought by the inventor may be gleaned from a fair reading of the claims that conclude this specification.

DESCRIPTION OF THE PREFERRED EMBODIMENT

Figure 1:
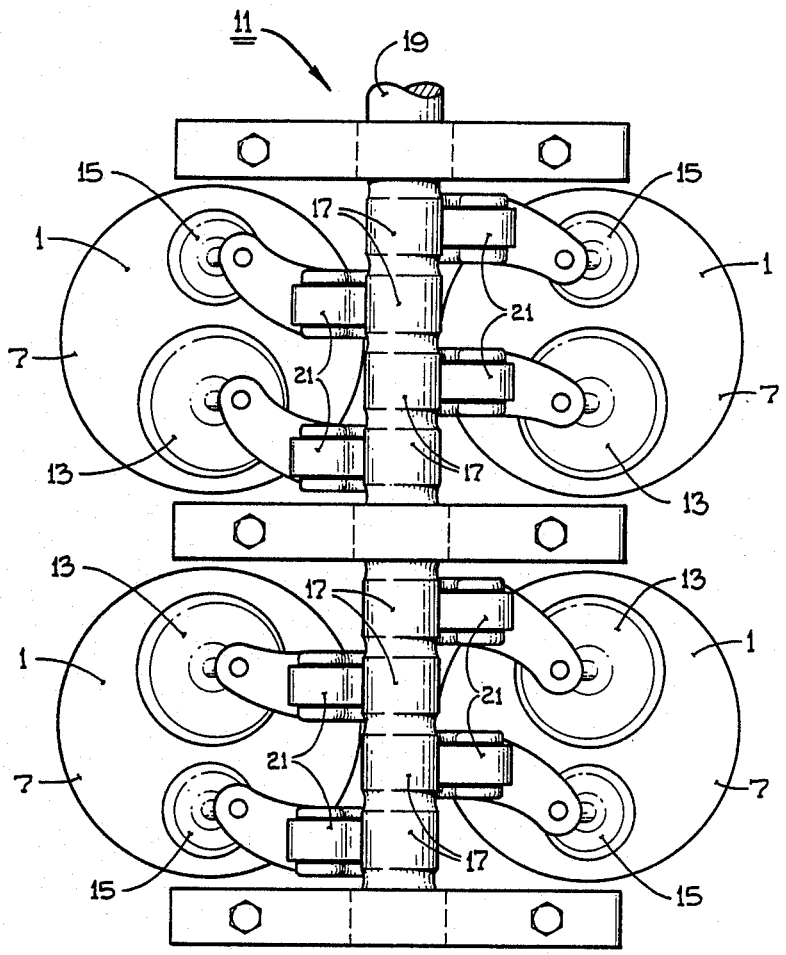
FIG. 1 is a top plan view of one arrangement of combustion chambers embodying my invention.
Figure 2:
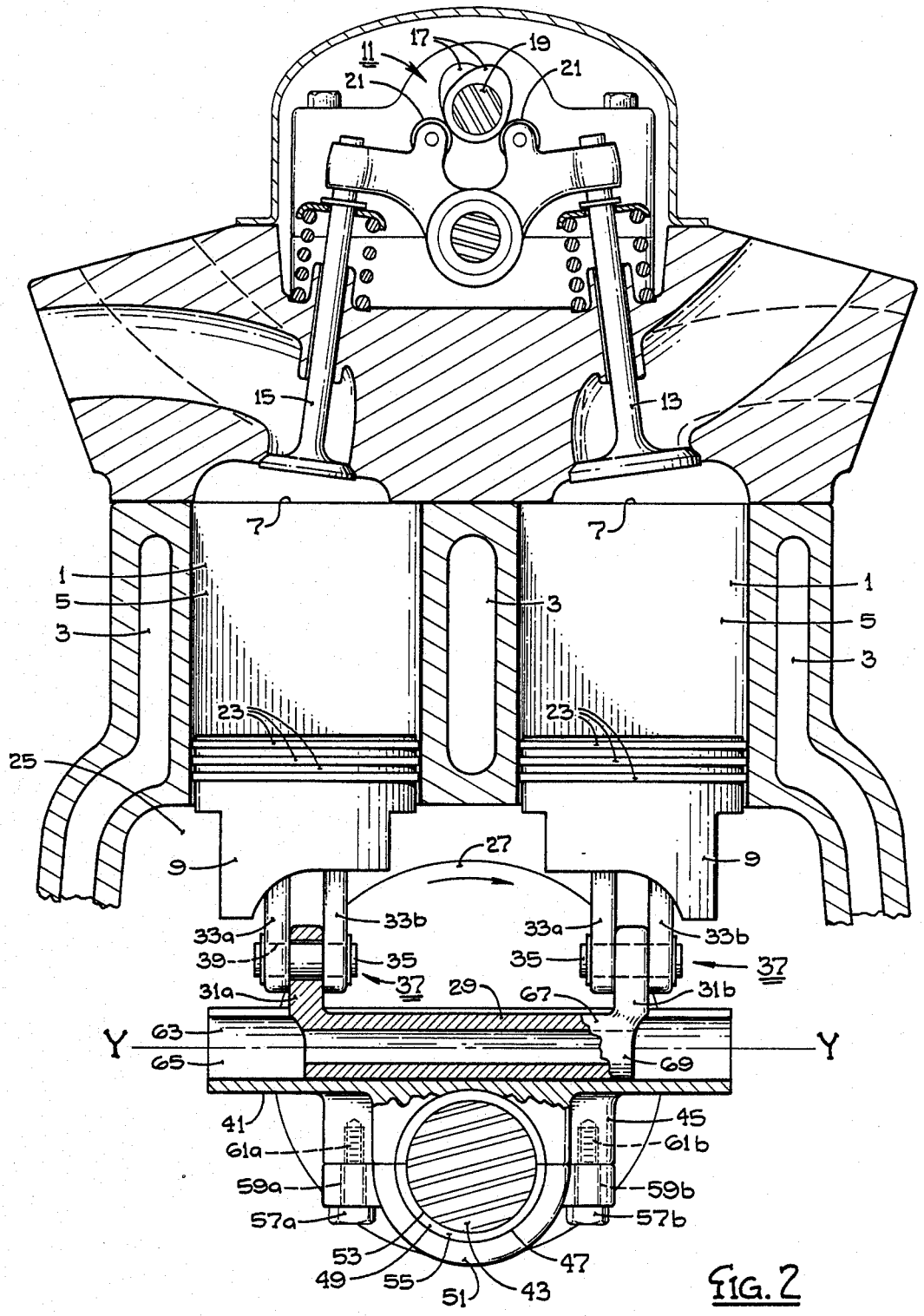
FIG. 2 is a front elevation, partial sectional view of a typical internal combustion engine design showing one embodiment of my invention with the powered crankshaft throw at bottom dead center (BDC)
Figure 3:
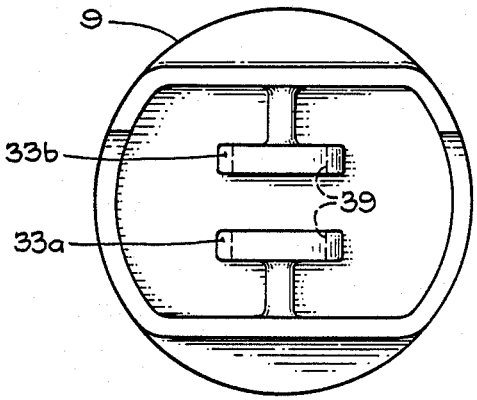
FIG. 3 is a bottom view of a piston designed for attachment to a carrier member of the type shown in FIG. 2.

I have chosen to describe my invention by grouping most of the known components of a typical 4-cycle reciprocating internal combustion together in what has been termed in the prior art as a "combustion chamber." In FIG. 1 is a top view of four combustion chambers 1 each containing a liquid-coolant jacket 3 (see FIG. 2) surrounding a cylinder 5 that is closed at one end 7 and wherein a piston 9 reciprocates (see FIGS. 2–3). A first means 11 includes a set of intake valves 13 and exhaust valves 15 actuated through a series of cams 17 mounted on a rotating cam shaft 19 and cam followers 21 combine with a carburetor (not shown) and various tubes, ducts and manifolds (also not shown) to admit a combustible fuel/air mixture into cylinder 5 through closed end 7 whereupon it is compressed by the approach of piston 9, made tight-fitting to the cylinder walls by rings 23, to a predetermined degree whereupon it explodes and drives piston 9 to the other (open) end 25 of cylinder 5. The reciprocating movement of piston 9 is translated into rotation of an elongated crankshaft 27 rotating in the direction of the arrow and having an axis of rotation x—x (see FIG. 4). Upon the return stroke of piston 9, in a 4-cycle engine, an exhaust valve 15 is caused to be opened and the fumes from the burnt mixture exhausted from cylinder 5. In gasoline and methanol powered engines, the explosion is caused by an electrical spark that I have included in the general term "combustion chamber" whereas in a diesel powered engine the explosion is self-initiated As shown in FIG. 2, my invention takes the form of combining combustion chambers 1 into a plurality and preferably pairs in side-by-side parallel arrangement and then locking independent pistons 9 into unitary motion. This is accomplished by attaching a carrier member 29 to each pair of pistons 9 with attachment means 37. As shown in FIGS. 2–6, means 37 comprises first spaced-apart arms **31*a* and 31*b*, extending from member 29 toward separate closed cylinder ends 7, that are each received between spaced-apart pairs of second arms 33*a* and 33*b* (see Figure 3), extending downward from each piston 9 and held together by pins 35 in cross-bores 39 formed in said sets of arms 31*a*, 33*a* and 33*b* and 31*b*, 33*a* and 33*b*. The position of first arms 31*a*, 31*b*, and second arms 33*a* and 33*b*** may be reversed. Other attaching means are usable and fully contemplated herein.

As shown in FIGS. 2, 4, 5 and 6, a guide member 41 comprises a base 45, containing a semi-circular cut-out 47 for receipt of a first one-half sleeve bearing 49 and then positioning over the upper half of crankshaft throw 43. separate cap 51, also containing a semi-circular cut-out 53 for receipt of a second one-half sleeve bearing 55 is positioned over the lower half of throw 43 and held to base 45 by a pair of threaded cap bolts **57*a* and 57*b* that pass through holes 59*a* and 59*b* formed on each side of cut-out 53, and received in threaded holes 61*a* and 61*b* bored into base 45 on each side of cut-out 47. A pair of spaced-apart, parallel walls 63 extend upward from base 45 toward cylinders 9 and form therebetween a groove 65, whose axis y—y lies transverse to crankshaft axis x—x. Groove 65** preferably has a circular cross-section however, other profiles are usable and fully contemplated herein.

Carrier member 29 contains an elongated portion 67 extending downward between first arms **31*a* and 31*b* that is profiled to be received in groove 65 for sliding movement therein. While not shown, conventional pressure lubrication is fully contemplated herein. For light weight and ease of manufacture, it is preferred that elongated portion 67 be formed into a hollow sleeve 69 whose wall is in full, sliding contact with the surface of groove 65**.

Figure 5:
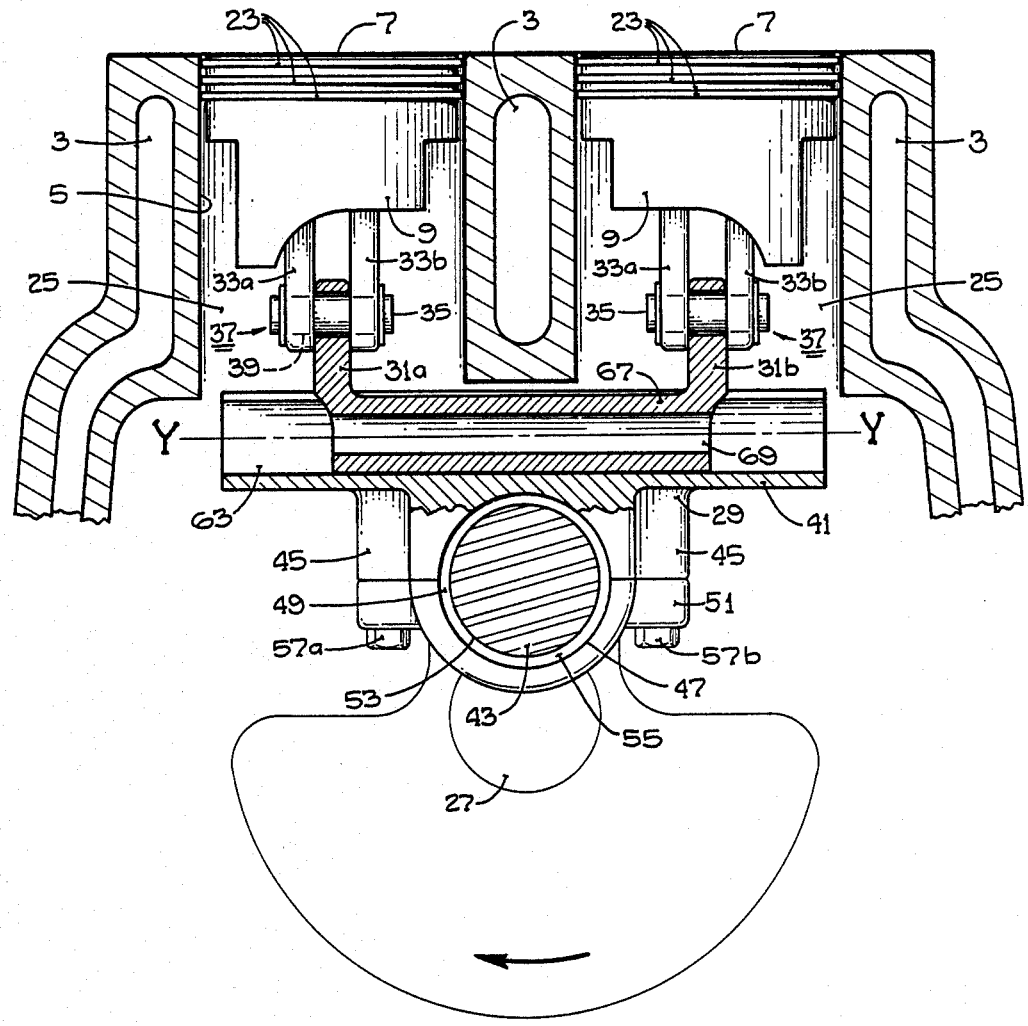
FIG. 5 is a front elevational partial sectional view of the embodiment shown in FIG. 2 with the pistons at top dead center (TDC); and, FIG. 6 is the same view as FIG. 5 with the pistons 90° after top dead center (ATDC).
Figure 6:
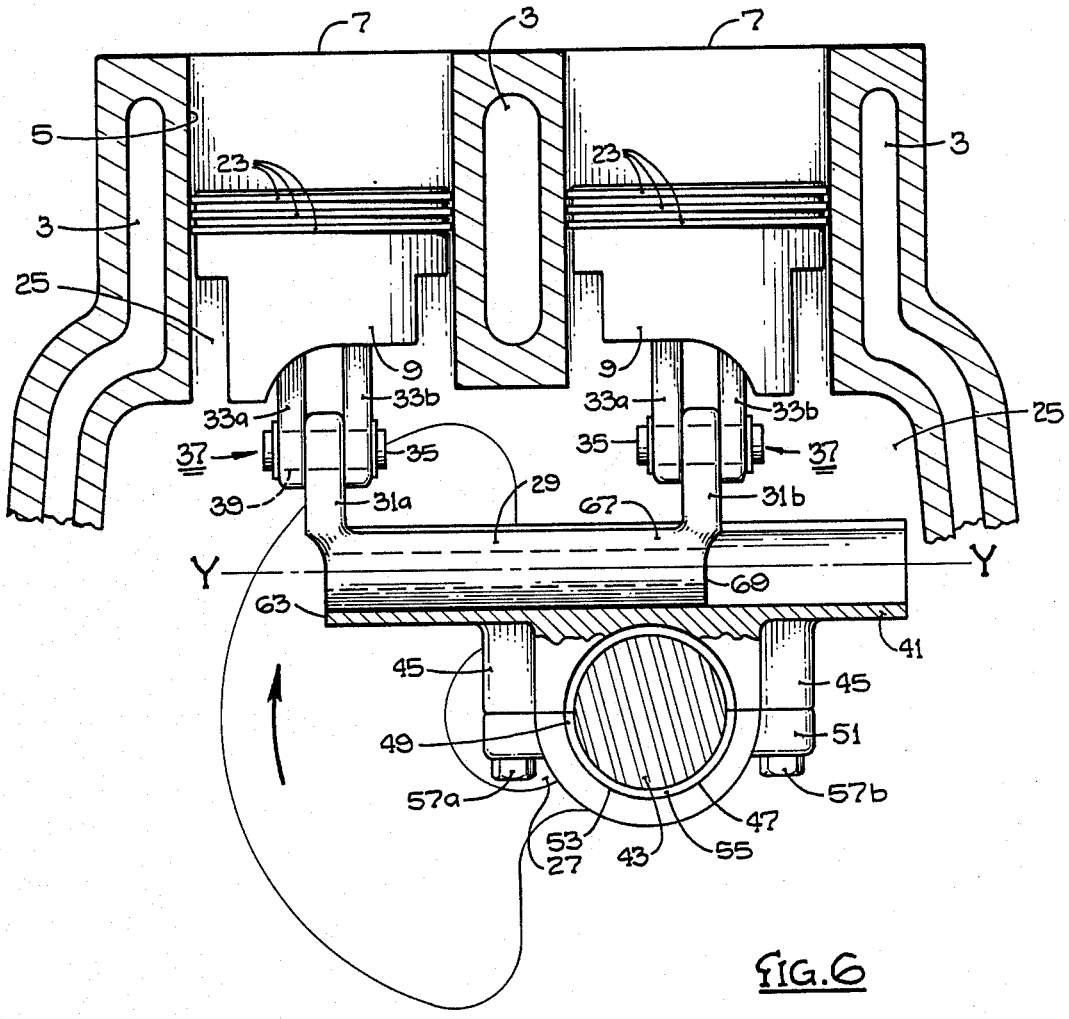

In operation, guide member 41 is positioned directly over crankshaft 27 and centered between pistons 9 when they are at top dead center (TDC) as shown in FIG. 5. In this position the combustible fuel/air mixture is in a highly compressed state and ready for ignition Upon ignition, pistons 9 are driven downward in cylinders 5. This downward pressure is transferred through first and second arms **31*a* and 31*b*, 33*a* and 33*b* to carrier member 29 that, in turn, presses downward on guide member 41. Guide member 41 forces throw 43 to begin an outward and downward motion thereby rotating crankshaft 27. After 90° of rotation, i.e., 90° ATDC, guide member 41 reaches its farthest sideways movement and begins to slide back toward crankshaft axis x—x, see FIG. 6. A11 the time, direct pressure is applied downward from pistons 9 through carrier member 29 through groove 65 to guide member 41 to crankshaft 27**; no side thrust is developed.

Figure 4:
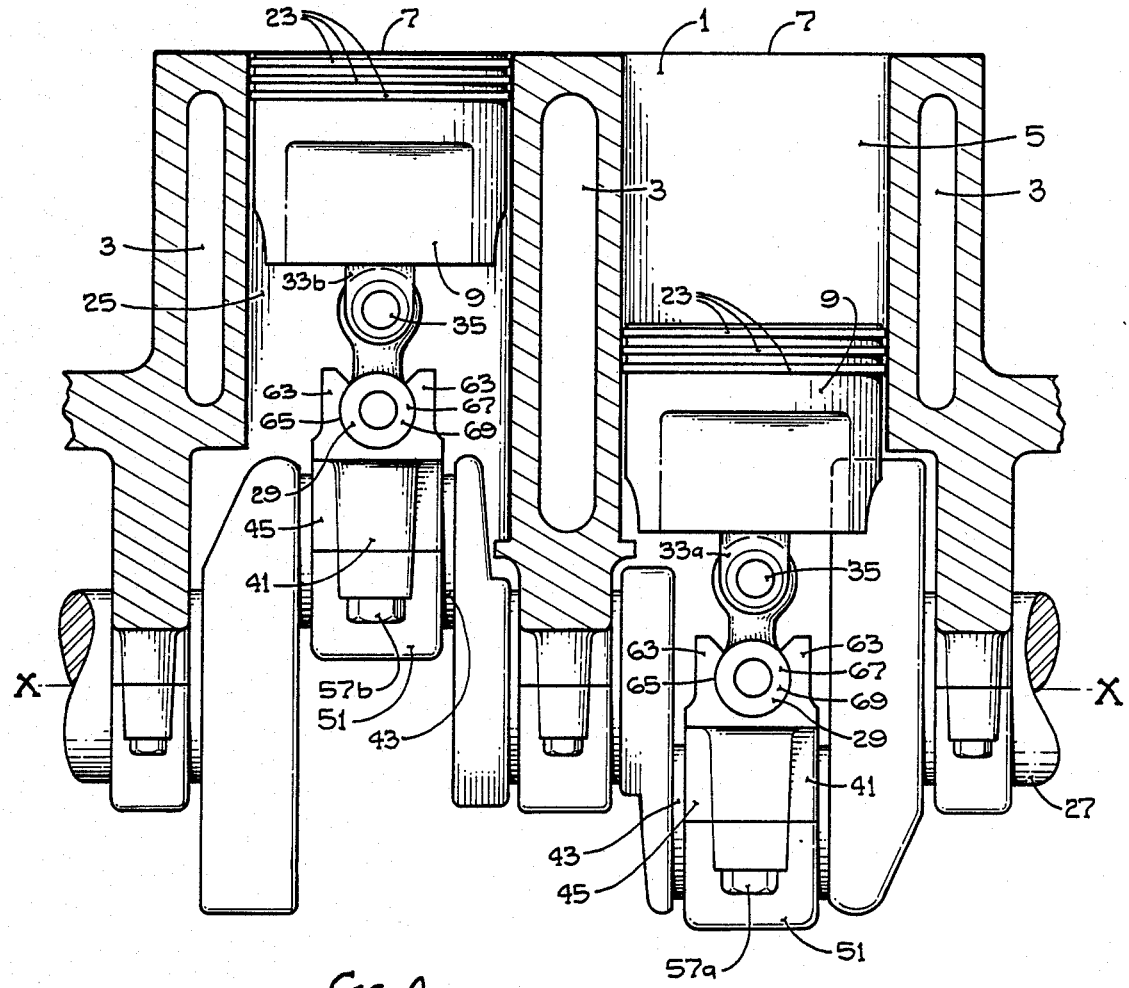
FIG. 4 is a side elevation view, partially in section, of two pairs of cylinders using my invention.

More than one pair of combustion chambers may be joined together, as shown in FIGS. 1 and 4, to maximize the benefits of this invention. In 2-cycle engines, the piston is in a power stroke each time it moves from the closed end to the open end of the cylinder. Thus, using this invention, both pistons undergo power strokes all the time. In 4-cycle engines, the piston undergoes a power stroke on every other reciprocation. To maximize the benefits of this invention in this situation, it is preferred that the ignition be arranged to cause the pistons to undergo alternate power strokes so that each downward movement of carrier member 29 is in response to a power stroke of one piston.

What I claim is:

1. In a reciprocating, multicylinder, internal combustion engine having an axially rotating power output crankshaft, the combination of:

(a) plurality of combustion chambers in side-by-side parallel arrangement, each said chamber containing first means to admit a combustible fuel/air mixture and to exhaust the fumes of combustion;

(b) a separate cylinder having an open end and a closed end forming part of each combustion chamber and a piston working independently in each cylinder and arranged to travel toward said closed end to compress the mixture and be driven in a power stroke toward said open end as a result of the burning of the mixture;

(c) a carrier member and means to attach said member to a pair of adjacent pistons for interconnecting them to reciprocate in unison in their respective cylinders; and, (d) a guide member, pivotally attached to an offset throw formed in said output crankshaft connected to said carrier member in sliding engagement therewith to convert the reciprocating motion of said pistons into rotary motion of said crankshaft through motion in a plane lying transverse to the axis of said crankshaft.

2. The combination of claim 1 involving two said combustion chambers.

3. The combination of claim 1 wherein said means to attach said carrier member to said pair of adjacent pistons comprises a first pair spaced-apart arms extending from said member toward said closed end of each said cylinder, that are received between a pair of spaced-apart pairs of second arms, extending downward from each said piston.

4. The combination of claim 3 wherein said respective first spaced-apart arms are fastened to said respective pairs of second arms by pins received in cross-bores formed in said first and second arms.

5. The combination of claim 1 wherein:

(a) said guide member includes a pair of spaced-apart parallel walls extending upward toward said cylinders and forming therebetween a groove having an axis lying transverse to the axis of said crankshaft, and having a circular cross-sectional profile; and, (b) said carrier member includes an elongated portion, extending downward between said first arms having a circular cross-sectional profile for receipt in said groove in sliding relationship therewith.

6. The combination of claim 1 wherein the ignition of said engine is set to provide simultaneous power strokes in each of said pistons.

7. The combination of claim 1 wherein the ignition of said engine is set to provide alternate power strokes in each of said pistons.

* * * * *